US006470637B2

(12) United States Patent
Gratz

(10) Patent No.: US 6,470,637 B2
(45) Date of Patent: Oct. 29, 2002

(54) CORNER PROTECTOR

(75) Inventor: Jeffrey J. Gratz, Hartland, WI (US)

(73) Assignee: Fibreform Containers, Inc., Germantown, WI (US)

( * ) Notice: Subject to any disclaimer, the term of this patent is extended or adjusted under 35 U.S.C. 154(b) by 0 days.

(21) Appl. No.: 09/797,134

(22) Filed: Mar. 1, 2001

(65) Prior Publication Data

US 2002/0121058 A1 Sep. 5, 2002

(51) Int. Cl.[7] ..... E04B 2/00

(52) U.S. Cl. ..... 52/287.1; 40/778; 206/453; D8/403

(58) Field of Search ..... 52/287.1

(56) References Cited

U.S. PATENT DOCUMENTS

| | | | | |
|---|---|---|---|---|
| 2,733,851 A | | 2/1956 | Van Ness | |
| 3,478,867 A | | 11/1969 | Weiss | |
| 3,589,511 A | | 6/1971 | Britt | |
| 3,771,646 A | | 11/1973 | Mascetti, Jr. | |
| 3,777,885 A | | 12/1973 | Barteck | |
| 3,799,382 A | | 3/1974 | Munroe | |
| 3,904,030 A | | 9/1975 | Repp et al. | |
| 4,416,374 A | | 11/1983 | Smith et al. | |
| 4,671,407 A | | 6/1987 | Brutosky | |
| 4,706,809 A | | 11/1987 | Halsell | |
| 4,722,440 A | | 2/1988 | Johnston | |
| 4,944,398 A | | 7/1990 | Gatt | |
| 5,447,233 A | * | 9/1995 | Smith | 206/453 |
| 5,469,962 A | | 11/1995 | Kitagawa et al. | |
| 5,671,856 A | | 9/1997 | Lisch | |
| D385,180 S | * | 10/1997 | Brandes | D8/403 |
| D394,603 S | * | 5/1998 | Brandes | D8/403 |
| 5,799,429 A | * | 9/1998 | Speshyock | 40/778 |
| 5,896,992 A | | 4/1999 | McGrath | |
| 5,967,306 A | | 10/1999 | Umiker | |

* cited by examiner

*Primary Examiner*—Carl D. Friedman
*Assistant Examiner*—Steve Varner
(74) *Attorney, Agent, or Firm*—Boyle Fredrickson Newholm Stein & Gratz S.C.

(57) ABSTRACT

A corner protector is provided for protecting a corner of an object. The corner protector includes first and second spaced sidewalls. Each sidewall includes an outer edge having a notch formed therein in order to allow sidewalls to flex. A connection element interconnects the first and second sidewalls such that the inner surfaces of the first and second sidewalls define an object receiving cavity therebetween. Support shoulders are provided within the object receiving cavity of the corner protector to support the corner of the object when inserted therein.

18 Claims, 3 Drawing Sheets

FIG. 4
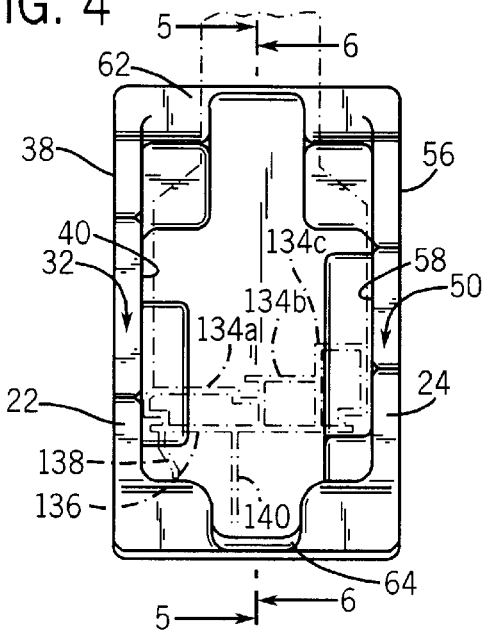
FIG. 5
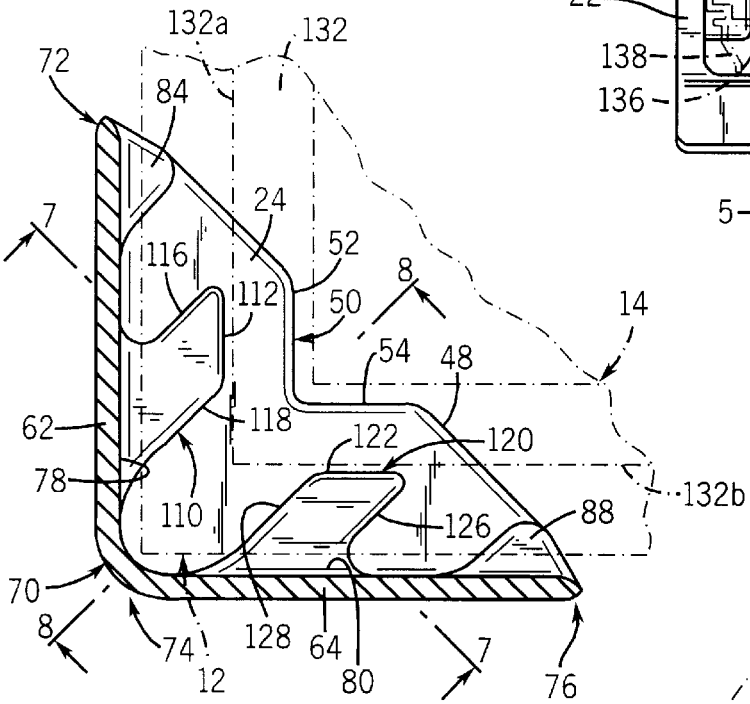
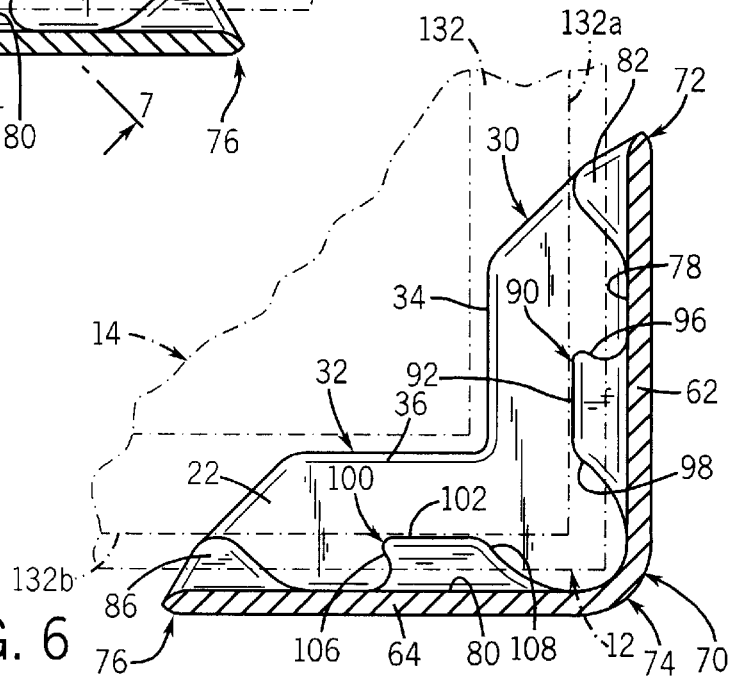
FIG. 6

FIG. 7
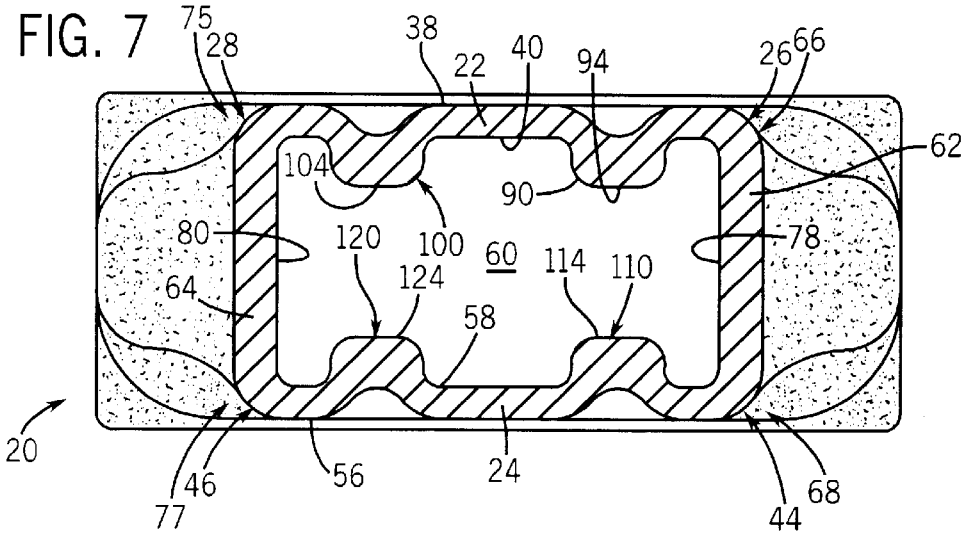
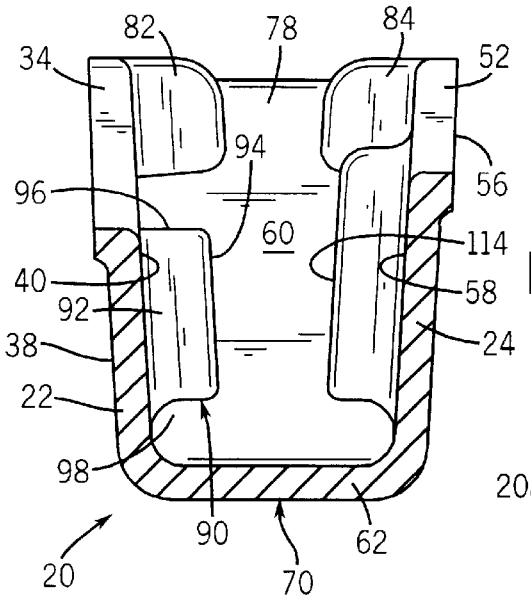
FIG. 8
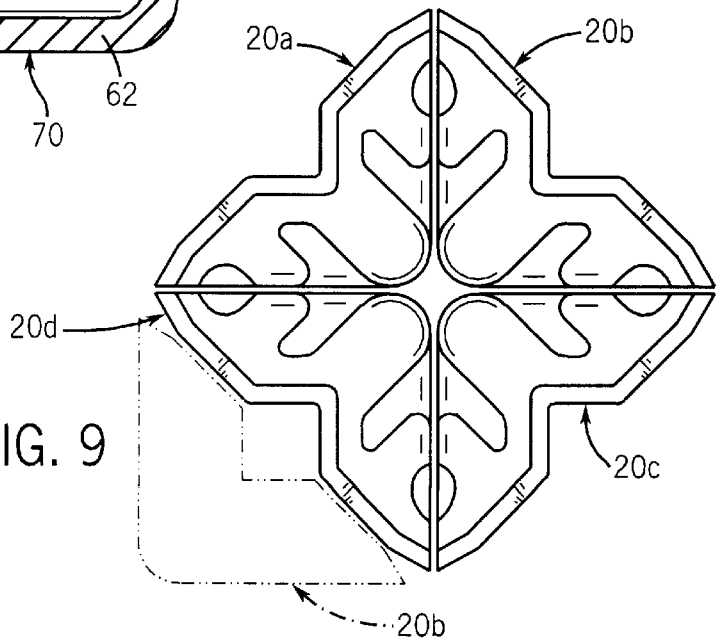
FIG. 9

CORNER PROTECTOR

FIELD OF THE INVENTION

This invention relates generally to corner protections, and in particular, to a corner protector for protecting a corner of an object such as a window or the like during shipment.

BACKGROUND AND SUMMARY OF THE INVENTION

Heretofore, a wide variety of corner protectors have been manufactured to protect the corners of various types of objects such as windows or the like during shipment of the objects. However, these prior art corner protectors have significant drawbacks which limit their use and/or effectiveness. For example, prior art expanded polystyrene corner protectors are often perceived to be environmentally unfriendly. As is known, expanded polystyrene is not biodegradable, and hence, may be banned from landfills or the like. Many insurance companies refuse to allow their clients to store expanded polystyrene in factories and warehouses due to fire related concerns. As such, users of corner protectors have sought a more environmentally sound alternative to the expanded polystyrene products.

In order to address environmental concerns, corner protectors have been developed which are manufactured from other types of material such as molded pulp. However, these molded pulp corner protectors often times do not have sufficient strength to protect the corners of an object from possible damage during shipment thereof. Further, due to the substantial flexibility of products manufactured from molded pulp, these types of prior art corner protectors tend to be too flexible thereby compromising, the amount of protection provided for the corners of the object.

Therefore, it is a primary object and feature of the present invention to provide a molded pulp corner protector which optimizes the strength and the flexibility thereof in order to protect the corners of an object during shipment.

It is a still further object and feature of the present invention to provide a corner protector which is inexpensive to manufacture and simple to utilize.

It is a still further object and feature of the present invention to provide a corner protector which is biodegradable, and hence, environmentally friendly.

In accordance with the present invention, a corner protector is provided for protecting a corner of an object such as a window or the like. The corner protector includes a first end wall lying in a first plane. The first end wall has first and second sides and first and second ends. The second end wall lies in a second plane which is perpendicular to the first plane. The second end wall also has first and second sides. A first sidewall interconnects the first sides of the first and second end walls, and has an outer edge extending between the second ends of the first and second end walls. The outer edge includes a notch formed therein. A second sidewall interconnects the second sides of the first and second end walls. The second sidewall has an outer edge extending between the second ends of the first and second end walls. The outer edge of the second sidewall also includes a notch therein.

The first and second sidewalls of the corner protector include inner surfaces which define an object receiving cavity therebetween for receiving the corner of the object. A first support shoulder extends inwardly from the inner surface of the first sidewall. The first support shoulder is defined by an object engaging surface and an inwardly directed surface. A second support shoulder extends inwardly from the inner surface of the first sidewall. The second support shoulder is defined by an object engaging surface and an inwardly directing surface. The object engaging surface of the first support shoulder is generally perpendicular to the object engaging surface of the second support shoulder. Alternatively, the second support shoulder extends inwardly from the inner surface of the second sidewall. As such, the object engaging inner surface of the first shoulder lies in a parallel plane with the object engaging surface of the second support shoulder.

The notch in the outer edge of the first sidewall is defined by a first edge portion which is generally parallel to the first end wall and a second edge portion which is generally parallel to the second end wall. The first end wall includes the inner surface directed towards the object receiving cavity. The inner surface of the first end wall and the inner surface of the first sidewall are interconnected by a rib.

In accordance with a further aspect of the present invention, a corner protector is provided for protecting a corner of an object such as a window or the like. The corner protector includes a first sidewall lying in a first plane. The first sidewall has an inner surface and an outer edge which includes a notch formed therein. A second sidewall lies in a second plane. The second sidewall has an inner surface and an outer edge which includes a notch formed therein. A first support shoulder extends from the inner surface of the first sidewall. The first support shoulder is defined by an object engaging surface and an inwardly directing surface. A second support shoulder extends from the second sidewall. The second support shoulder is also defined by an object engaging surface and an inwardly directed surface. A connection element interconnects the first sidewall and a second sidewall such that the inner surfaces of the first sidewall and second sidewall define an object receiving cavity therebetween.

The connection element includes a first end wall having a first side interconnected to the first sidewall and a second side interconnected to the second sidewall. The first end wall further includes first and second opposite ends. A second end wall extends from the second end of the first end wall. The second end wall includes a first side interconnected to the first sidewall and a second side interconnected to the second sidewall. The second sidewall also includes first and second opposite ends. The first end of the second end wall is interconnected to the first end of the first end wall.

The outer edge of the first sidewall extends between the second ends of the first and second end wall. Similarly, the outer edge of the second sidewall extends between the second ends of the first and second end walls. The notch in the outer edge of the first sidewall is defined by a first edge portion and is generally parallel to the first end wall and a second edge portion which is generally parallel to the second end wall.

The first end wall also includes an inner surface directed towards the object receiving cavity. The inner surface of the first end wall and the inner surface of the first sidewall are interconnected by a rib. In addition, the object engaging surface of the first support shoulder lies in parallel planes with the object engaging surface of the second support shoulder.

In accordance with a still further aspect of the present invention, a corner protector is provided for protecting a corner of an object. The corner protector includes a first sidewall lying in a first plane. The first sidewall has an inner surface and an outer edge which includes a notch formed therein. The second sidewall lies in a second plane. The second sidewall has an inner surface and an outer edge which includes a notch formed therein. A first support shoulder extends from the inner surface of the first sidewall. The first support shoulder is defined by an object engaging surface and an inwardly directing surface. A second support shoulder extends from the inner surface of the second sidewall. The second support shoulder is defined by an object engaging surface and an inwardly directing surface. A first end wall has a first side interconnected to the first sidewall and a second side interconnected to the second sidewall. The first end wall further includes first and second opposite ends. A second end wall has a first side interconnected to the first sidewall and a second side interconnected to the second sidewall. The second sidewall further includes first and second opposite ends.

It is contemplated that the first end of the first end wall be interconnected to the first end of the second end wall. In addition, the first and second end walls are generally perpendicular to each other. The notch of the outer edge of the first sidewall is defined by a first edge portion which is generally parallel to the first end wall and a second edge portion which is generally parallel to the second end wall. The first end wall includes an inner surface directed towards the object receiving cavity. The inner surface of the first sidewall and the inner surface of the first end wall are interconnected by a rib. The object engaging surface of the first support shoulder lies in a plane parallel to the object engaging surface of the second support shoulder.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 4 is a cross-sectional view taken along line 4—4 of FIG. 2;

FIG. 5 is a cross-sectional view taken along line 5—5 of FIG. 4;

FIG. 6 is a cross-sectional view taken along line 6—6 of FIG. 4;

FIG. 7 is a cross-sectional view taken along line 7—7 of FIG. 5;

FIG. 8 is a cross-sectional view taken along line 8—8 of FIG. 5; and FIG. 9 is a top plan view of a plurality of corner protectors in accordance with the present invention.

DETAILED DESCRIPTION OF THE PREFERRED EMBODIMENT

Figure 1:
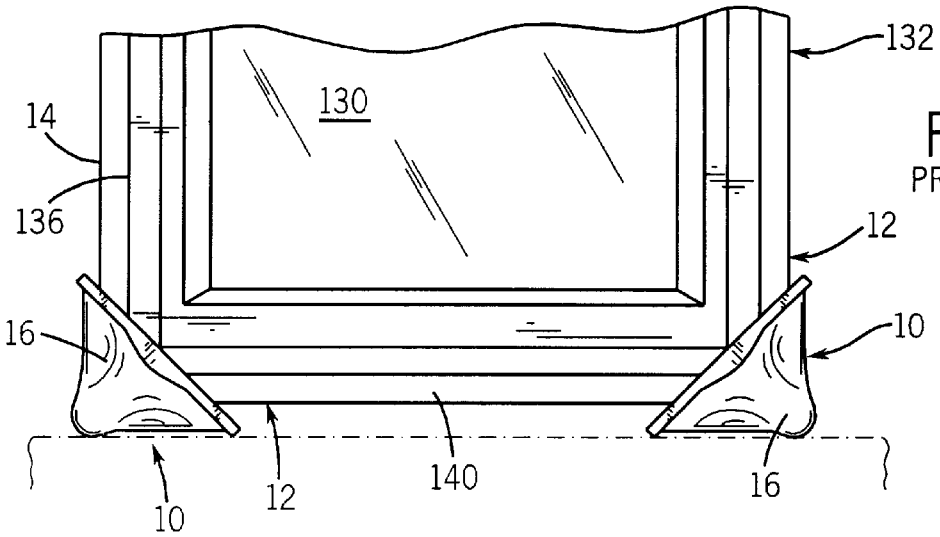
FIG. 1 PRIOR ART
FIG. 1 is the side elevational view of the first and second prior art corner protectors placed over corresponding corners of an object.
Figure 2:
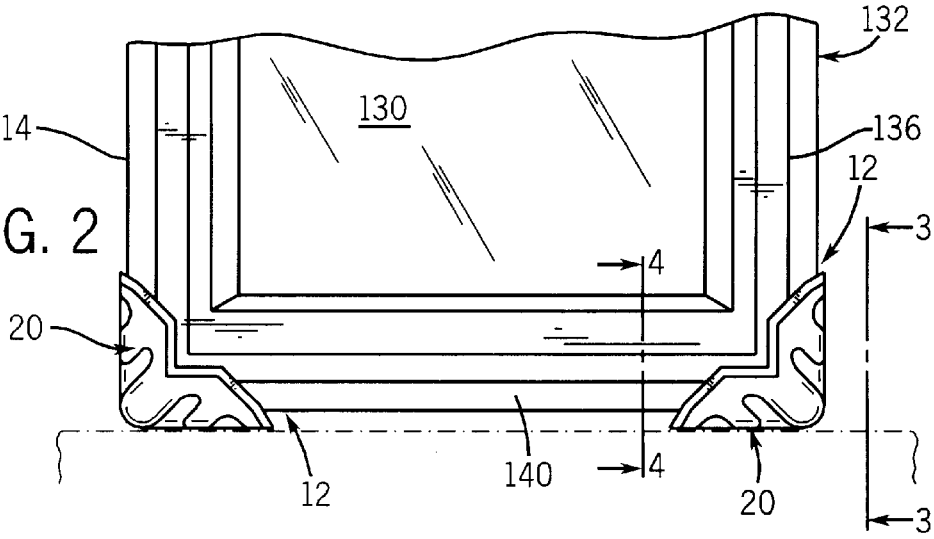
FIG. 2 is a side elevational view of first and second corner protectors in accordance with the present invention placed over corresponding corners of an object.

Referring to FIG. 1, a prior art corner protector is, generally designated by the reference numeral 10. Each prior art corner protector 10 is intended to be positioned about a corresponding corner 12 of an object, such as window 14, in order to protect corners 12 during shipment. Each prior art corner protector includes generally triangular sidewalls 16 which define a corner receiving trough therebetween. Sidewalls 16 of prior art corner protectors 10 are generally flat such that the inner surfaces thereof are free of any projections, support structures or ribs.

Referring to FIGS. 2–9, a corner protector in accordance with the present invention is generally designated by the reference numeral 20. In a preferred embodiment, corner protector 20 is manufactured from a molded pulp material. However, it is contemplated to manufacture corner protector 20 from other types of materials without deviating from the scope of the present invention.

As best seen in FIGS. 4–8, corner protector 20 includes a first sidewall 22 lying in a first plane and a second sidewall 24 lying in a second plane generally parallel to the first plane. First sidewall 22 is generally triangular in shape and includes a first side 26 and a second side 28 interconnected by an outer edge 30 extending along the hypotenuse thereof. A notch 32 is formed in outer edge 30 of first sidewall 22. Notch 32 is defined by a first edge portion 34 and a second edge portion 36. First notch portion 34 and second notch portion 36 are generally perpendicular to each other. First sidewall further includes an outer surface 38 and an inner surface 40 directed towards second sidewall 24.

As best seen in FIG. 6, second sidewall 24 is generally triangular in shape and includes first and second sides 44 and 46, respectively, interconnected by an outer edge 48 extending along the hypotenuse thereof. Outer edge 48 includes a notch 50 formed therein. Notch 50 is defined by a first edge portion 52 and a second edge portion 54. First edge portion 52 and second edge portion 54 of outer edge 48 of second sidewall 24 are generally perpendicular to each other. Second sidewall 24 further includes an outer surface 56 and an inner surface 58 directed towards first sidewall 22. Inner surface 58 of second sidewall 26 and inner surface 40 of first sidewall 24 define a corner receipt cavity 60, FIG. 8, therebetween.

First and second sidewalls 22 and 24, respectively, are interconnected by first and second end walls 62 and 64, respectively. First end wall 62 includes first and second sides 66 and 68, respectively, and first and second ends 70 and 72, respectively. First side 66 of first end wall 62 is integrally molded with first side 26 of first sidewall 22. Second side 68 of first end wall 62 is integrally molded with first side 44 of second sidewall 24. In addition, first end 70 of first end wall 62 is integrally molded with first end 74 of second end wall 64.

Similarly, second end wall 64 includes first and second sides 75 and 77, respectively. First side 75 of second end wall 64 is integrally molded with second side 28 of second sidewall 24. Second side 77 of second end wall 64 is integrally molded with second side 46 of second sidewall 26. As described, outer edge 30 of first sidewall 22 extends between second end 72 of first end wall 62 and second end 76 of second end wall 64. Similarly, outer edge 48 of second sidewall 24 extends between second end 72 of first end wall 62 and second end 76 of second sidewall 64.

First and second end walls 62 and 64, respectively, include corresponding inner surfaces 78 and 80, respectively, which are directed towards and partially define corner receipt cavity 60. Rib 82 extends between the inner surface 40 of first sidewall 22 and inner surface 78 of first end wall 62 at a location adjacent second end 72 of first end wall 62. Rib 84 extends between inner surface 58 of second sidewall 24 and inner surface 78 of first end wall 62 at a location adjacent second end 72 of first end wall 62. Ribs 82 and 84 add strength and stability to corner protector 20 and discourage damage to first end wall 62 during use of corner protector 20.

Rib 86 extends between inner surface 40 of first sidewall 22 and inner surface 80 of second end wall 64. Rib 88 extends between inner surface 58 of second sidewall 24 and inner surface 80 of second end wall 64. Ribs 86 and 88 add strength and stability to corner protector 20 and discourage damage to second end wall 64 during use of corner protector 20.

Corner protector 20 further includes a first support shoulder 90 which projects inwardly from inner surface 40 of first sidewall 22. First support shoulder 90 is defined by an object engaging surface 92 projecting from inner surface 40 and being generally parallel to inner surface 78 of first end wall 62. Object engaging surface 92 of first support shoulder 90 is interconnected to inner surface 78 of first end wall 62 by inwardly directed surface 94 and by sides 96 and 98. Second support shoulder 100 projects inwardly from inner surface 40 of first sidewall 22. Second support shoulder 100 includes an object engaging surface 102 which extends from inner surface 40 of first sidewall 22 and is generally parallel to inner surface 80 of second end wall 64. Object engaging surface 102 is interconnected to inner surface 78 by inwardly directed surface 104 and by sides 106 and 108. As described, object engaging surface 102 of second support shoulder 100 and object engaging surface 92 of first support shoulder 90 are generally perpendicular to each other.

Second sidewall 24 includes a first support shoulder 116 projecting inwardly therefrom. First support shoulder 110 of second sidewall 24 includes an object engaging surface 112 projecting from inner surface 58 of second sidewall 24 and is generally parallel to inner surface 78 of first end wall 62. Object engaging surface 112 of first support shoulder 110 is interconnected to inner surface 78 of first end wall 62 by inwardly directed surface 114 and by sides 116 and 118. Second sidewall 24 includes a second support shoulder 120 projecting therefrom. Second support shoulder 120 of second sidewall 24 includes an object engaging surface 122 which extends from inner surface 58 of second sidewall 24 and is generally parallel to inner surface 80 of second end wall 64. Object engaging surface 122 is interconnected to inner surface 80 of second end wall 64 by inwardly directed surface 124 and sides 126 and 128.

In operation, corner protectors 20 are intended to protect the corners 12 of an object such as window 14. Window 14 includes one or more transparent panes 130 mounted within a generally rectangular frame generally designated by the reference numeral 132. Frame 132 of window 14 often is formed from multiple tubular elements 134*a–c*, FIG. 4, which define the outer surface 136 of frame 132. First and second mounting flanges 138 and 140 project radially from outer surface 136 of frame 132 to facilitate the mounting of window 14 within an opening.

Comer protector 20 is positioned over a corresponding corner 12 of window 14 such that corner 12 is received within corner receiving cavity 60 of corner protector 20. By way of example, referring to FIGS. 5–6, corner 12 of window 14 is received within corner receiving cavity 60 in corner protector 20 such that a first side 132*a* of frame 132 engages object engaging surface 92 of first support shoulder 90 extending from first sidewall 22 and engages object engaging surface 112 of first shoulder 110 extending from first second sidewall 24. In addition, the second side 132*b* of frame 132 of window 14 engages object engaging surface 102 of second support shoulder 100 extending from first sidewall 22 and engages object engaging surface 122 of second support shoulder 120 extending from second sidewall 24. Notches 32 and 50 in first and second sidewalls 22 and 24, respectively, allow first and second sidewalls 22 and 24, respectively, to flex and snugly retain corner protector 20 on corner 12 on window 14.

Figure 3:
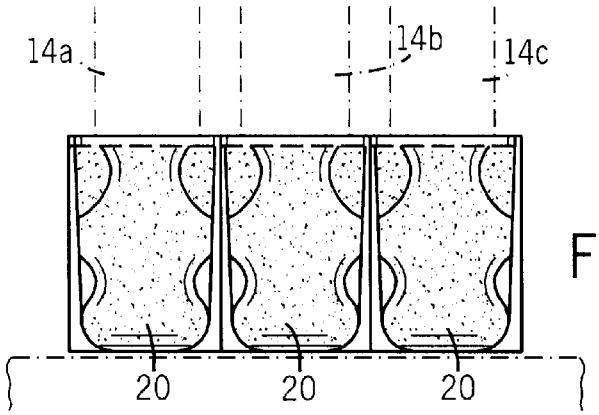
FIG. 3 is an end view taken along line 3—3 of FIG. 2.

Referring to FIG. 3, it can be appreciated that corner protectors 20 may be positioned over the corners 12 of a plurality of windows 14*a–c*, such that the plurality of windows 14*a–c* may be vertically stacked adjacent one another in a spaced relationship so as to prevent damage to the plurality of 14*a–c* during transport. Referring to FIG. 9, it can be further appreciated that due to their triangular shape, a group of four corner protectors 20*a*–20*d* may be arranged to form a generally rectangular configuration so as to minimize the space requirements of corner protectors 20*a–d* during transport and storage.

Various modes of carrying, out the invention are contemplated as being within the scope of the following claims particularly pointing out and distinctly claiming the subject matter which is regarded as the invention.

I claim:

1. A corner protector for protecting a corner of an object, comprising:

a first end wall lying in a first plane, the first end wall having first and second sides and first and second ends;

a second end wall lying in a second plane perpendicular to the first plane, the second end wall having first and second sides;

a first side wall interconnecting the first sides of the first and second end walls, the first side wall having an outer edge extending between the second ends of the first and second end walls which includes a notch formed therein;

a second side wall interconnecting the second sides of the first and second end walls, the second side wall having an outer edge extending between the second ends of the first and second end walls which includes a notch formed therein; and a first support shoulder extending inwardly from the inner surface of the first side wall, the first support shoulder defined by an object engaging surface and an inwardly directed surface; and wherein the first and second side walls include inner surfaces which defines an object receiving cavity therebetween.

2. The corner protector of claim 1, further comprising a second support shoulder extending inwardly from the inner surface of the first side wall, the second support shoulder defined by an object engaging surface and an inwardly directed surface.

3. The corner protector of claim 2 wherein the object engaging surface of the first support shoulder is generally perpendicular to the object engaging surface of the second support shoulder.

4. The corner protector of claim 1 further comprising a second support shoulder extending inwardly from the inner surface of the second side wall, the second support shoulder defined by an object engaging surface and an inwardly directed surface.

5. The corner protector of claim 4 wherein the object engaging surface of the first support shoulder lies in a common plane with the object engaging surface of the second support shoulder.

6. A corner protector for protecting a corner of an object, comprising:

a first side wall lying in a first plane, the first side wall having an inner surface and an outer edge which includes a notch formed therein;

a second side wall lying in a second plane, the second side wall having an inner surface and an outer edge which includes a notch formed therein;

a first support shoulder extending from the inner surface of the first side wall, the first support shoulder defined by an object engaging surface and an inwardly directed surface;

a second support shoulder extending from the inner surface of the second side wall, the second support shoulder defined by an object engaging surface and an inwardly directed surface; and a connection element interconnecting the first side wall and the second side wall such that inner surfaces of the first and side wall define an object receiving cavity therebetween.

7. The corner protector of claim 6 wherein the connection element includes:

a first end wall having a first side interconnected to the first side wall and a second side interconnected to the second side wall, the first end wall further including first and second opposite ends; and a second end wall extending from the second end of the first end wall and including a first side interconnected to the first side wall and a second side interconnected to the second side wall.

8. The corner protector of claim 7 herein the first end wall includes an inner surface directed towards the object receiving cavity and wherein the inner surface of the first end wall and the inner surface of the first side wall are interconnected by a rib.

9. The corner protector of claim 7 wherein the second end wall includes first and second opposite ends and wherein the first end of the second end wall is interconnected to the first end of the first end wall.

10. The corner protector of claim 9 wherein the outer edge of the first side wall extends between the second ends of the first and second end walls and wherein the outer edge of the second side wall extends between the second ends of the first and second end walls.

11. The corner protector of claim 10 wherein the notch in the outer edge of the first side wall is defined by a first edge portion which is generally parallel to the first end wall and a second edge portion which is generally parallel to the second end wall.

12. The corner protector of claim 6 wherein the object engaging surface of the first support shoulder lies in a common plane with the object engaging surface of the second support shoulder.

13. A corner protector for protecting a corner of an object, comprising:

a first side wall lying in a first plane, the first side wall having an inner surface and an outer edge which includes a notch formed therein;

a second side wall lying in a second plane, the second side wall having an inner surface and an outer edge which includes a notch formed therein;

a first support shoulder extending from the inner surface of the first side wall, the first support shoulder defined by an object engaging surface and an inwardly directed surface;

a second support shoulder extending from the inner surface of the second side wall, the second support shoulder defined by an object engaging surface and an inwardly directed surface;

a first end wall having a first side interconnected to the first side wall and a second side interconnected to the second side wall, the first end wall further including first and second opposite ends; and a second end wall having a first side interconnected to the first side wall and a second side interconnected to the second side wall, the second end wall further including first and second opposite ends.

14. The corner protector of claim 13 wherein the first end of the first end wall is interconnected to the first end of the second end wall and wherein the first and second end walls are generally perpendicular to each other.

15. The corner protector of claim 13 wherein the notch in the outer edge of the first side wall is defined by a first edge portion which is generally parallel to the first end wall and a second edge portion which is generally parallel to the second end wall.

16. The corner protector of claim 13 wherein the first end wall includes an inner surface directed towards the object receiving cavity and wherein the inner surface of the first end wall and the inner surface of the first side wall are interconnected by a rib.

17. The corner protector of claim 13 wherein the object engaging surface of the first support shoulder lies in a common plane with the object engaging surface of the second support shoulder.

18. A corner protector for protecting a corner of an object, comprising:

a first end wall lying in a first plane, the first end wall having first and second sides and first and second ends;

a second end wall lying in a second plane perpendicular to the first plane, the second end wall having first and second sides;

a first side wall interconnecting the first sides of the first and second end walls, the first side wall having an outer edge extending between the second ends of the first and second end walls which includes a notch formed therein;

wherein:

the first and second side walls include inner surface which defines an object receiving cavity therebetween;

the first end wall includes an inner surface directed towards the object receiving cavity; and the inner surface of the first end wall and the inner surface of the first side wall are interconnected by a rib.

* * * * *